US007413012B2

(12) United States Patent
Dávila

(10) Patent No.: US 7,413,012 B2
(45) Date of Patent: Aug. 19, 2008

(54) SYSTEM AND METHOD FOR COLLECTING ESCAPING HYDROCARBONS FROM A BREACHED WELL PIPE

(75) Inventor: Vicente González Dávila, Tamps (MX)

(73) Assignee: Geo Estratos, S.A. De C.V., CD. Madero, Tamps. (MX)

( * ) Notice: Subject to any disclaimer, the term of this patent is extended or adjusted under 35 U.S.C. 154(b) by 128 days.

(21) Appl. No.: 11/472,910

(22) Filed: Jun. 22, 2006

(65) Prior Publication Data

US 2006/0289159 A1 Dec. 28, 2006

(30) Foreign Application Priority Data

Jun. 22, 2005 (MX) ..... NL/A/2005/000052

(51) Int. Cl.
*E21B 43/00* (2006.01)

(52) U.S. Cl. ..... 166/277; 166/380; 166/81.1

(58) Field of Classification Search ..... 166/263, 166/277, 311, 312, 378, 379, 380, 81.1, 90.1, 166/81, 75.13, 100, 242.5, 243, 250.08
See application file for complete search history.

(56) References Cited

U.S. PATENT DOCUMENTS 1,736,117 A 11/1929 Granger
3,165,919 A 1/1965 Loomis
3,194,310 A 7/1965 Loomis
3,364,993 A 1/1968 Skipper
3,745,773 A 7/1973 Cunningham
5,246,067 A * 9/1993 Heinonen et al. ..... 166/81.1
5,267,469 A 12/1993 Espinoza
5,394,939 A * 3/1995 Walker ..... 166/81.1
5,511,573 A 4/1996 Corte
5,857,518 A * 1/1999 Vinson, Sr. ..... 166/81.1
2002/0179300 A1 * 12/2002 Gay et al. ..... 166/81.1
2004/0182567 A1 9/2004 Matthews
2005/0155757 A1 * 7/2005 Paton ..... 166/81.1
2007/0169931 A1 * 7/2007 Holthe ..... 166/81.1

* cited by examiner

*Primary Examiner*—Jennifer H Gay
*Assistant Examiner*—David Andrews
(74) *Attorney, Agent, or Firm*—Gunn & Lee, P.C.

(57) ABSTRACT

A method and system for containing escaping hydrocarbon fluid from a well pipe of a production well. Suppression of the hydrocarbon fluid to a level below the breach location using a control fluid allows the breach to be repaired through the installation of a containment sleeve at the location of the breach. After collecting the escaping hydrocarbon fluids with a containment sleeve, the hydrocarbon fluid is routed to a collection reservoir from which it may be easily recovered without causing environmental damage. This process occurs with minimal downtime of the production well with the added environmental benefit of remediation of earth contaminated by the hydrocarbon breach.

15 Claims, 6 Drawing Sheets

SYSTEM AND METHOD FOR COLLECTING ESCAPING HYDROCARBONS FROM A BREACHED WELL PIPE

REFERENCE TO A RELATED APPLICATION

This is a non-provisional application relating to the content of, and claiming priority to, Mexican Patent Application No. NL/a/2005/000052, filed Jun. 22, 2005, which is incorporated by reference herein.

BACKGROUND OF THE INVENTION

1. Field of the Invention.

The present invention relates to the field of crude oil production and, more specifically, to a system and method for collecting hydrocarbon fluid that is escaping through a breach in a well pipe of a hydrocarbon producing well. The terms "hydrocarbon producing well," "hydrocarbon well," "oil well," and "well" are used synonymously in this application.

2. Background of the Invention.

A typical hydrocarbon production well includes a production pipe nested within a casing pipe that provides support to the borehole of the well. While the production pipe communicates hydrocarbons to the surface, surrounding casing pipes primarily serve to reinforce the main borehole. Casing pipe, or casing, is an essential component of the well completion. For example, the casing prevents the formation wall from caving into the wellbore. Moreover, the casing provides a way for a well operator to control formation fluids and pressure as the well is drilled. A casing pipe must operate in a difficult environment and is subjected to a variety of forces and corrosive chemicals.

Generally, the production pipe and casing pipes are made of steel, which is susceptible to oxidation and corrosion over time that may cause the oil well to leak hydrocarbon fluids or gases through the casing pipes and into the surrounding earth. These leaked hydrocarbons may eventually surface at ground level and, as they move through the earth, cause a harmful environmental impact to surface and underground water and soil, as well as wildlife, during migration to the surface. Furthermore, any leaking oil translates to lost revenue and reduced efficiency of the well, especially when is a large volume of producer. Not surprisingly, the larger the breach in a casing pipe, the more revenue is lost.

Traditional methods for addressing this problem required the well operator to stop production and withdraw the leaking casing or production pipe from the well to seal the breach. Not only is this undesirable because of the lost revenue due to a production stop, but this can potentially create an economic disincentive for even repairing the smaller leaks; in other words, it may be more profitable to continue production despite the presence of a small leak in the casing rather that cease producing long enough to repair the leak. Such economic disincentive may make economic sense, but would not make environmental sense, as the surrounding earth, nearby water sources, and the wildlife ultimately pay a heavy price.

A review of the prior art in the field reveals other attempts at maintaining the integrity of well casing. Some inventions merely test the physical integrity of the production tubing or casing without repairing the breach. For example, U.S. Pat. No. 5,267,469 provides a method for testing the physical integrity of casing by applying a test pressure to the inner annular space of the wellbore and monitoring the test pressure for a pressure drop. By measuring the pressure in a sealed-off portion of the well annulus—the area between the production tubing and casing—and applying a known test pressure, the pressure can be monitored. Any drop in the test pressure indicates a breach in either the production tubing or the casing. The patent makes no provision, however, for repairing any such breach.

U.S. Pat. No. 3,194,310 discloses both locating and repairing the leak. A breakable capsule containing a sealing compound is disposed into the well to the position of the breach. After sealing the tubing both above and below the breach, the capsule is broken to allow the sealant to flow around the tool and be contained between the seals. Importantly, however, the production tubing must be removed from the well—and thus production substantially disrupted—to use the tool and method taught to seal a breach in the casing pipe.

Similarly, U.S. Pat. No. 3,364,993 also teaches a method of well casing repair in which the method of repairing a leak in a well pipe comprises placing an expansible patch around the breach, inflating the patch by injecting fluid into the patch to expand and set the patch against the breach. As with U.S. Pat. No. 3,194,310, though, this method disrupts the production piping within the well.

SUMMARY OF THE INVENTION

In contrast to the known prior art, the present invention provides an improved method for containing leaks from corroded well pipes that is less expensive and easier to implement than other methods for achieving a similar results. In addition, the present invention combines the containment functionality of typical locate-and-repair apparatuses with in-situ and ex-situ remediation of the earth which surrounds the breach in the well pipe.

Moreover, the present invention does not require a production pipe to be removed or disturbed. The method described herein requires only inhibiting the production for a brief period while the escaping hydrocarbon fluid is contained. The production pipe need not be moved or removed.

The problem of breaches in casing pipes can be solved with the use of a containment sleeve in combination with a collection reservoir to which the escaped hydrocarbon fluid is transported by way of a collection pipe. By pumping a control fluid (i.e., a fluid of greater density than the hydrocarbon fluid, such as salt water or brine solution) into the production pipe, the hydrocarbon fluid is forced to the bottom of the well pipe. Accordingly, the present invention comprises a control pump of sufficient head pressure to overcome the natural well pressure emanating from the well.

After pumping an amount of the control fluid sufficient to suppress the hydrocarbon fluid at the bottom of the well, the well valve, through which normal petroleum production occurs, is closed, leaving both the control fluid and the hydrocarbon fluid contained within the well pipe. The hydrocarbon fluid thus remains stable in the bottom of the well, allowing control fluid instead to escape from the breach. Thus, even while in a state of repair, loss of potentially commercially viable hydrocarbons is kept at a minimum.

Subsequent to the suppression of the hydrocarbon fluid, the ground around the well pipe is excavated sufficient to locate the breach in the well pipe. Control fluid will be escaping the breach, hopefully slowly, but will bide enough time to clean the area of the well pipe surrounding the breach in preparation of sealing a containment sleeve to the well pipe.

After this cleaning step, the containment sleeve is attached to the well pipe to seal the breach. According to the preferred embodiment of the invention, the containment sleeve includes a plurality of concave, non-metallic pieces that are fitted to the well pipe. The sleeve encircles the well pipe and bulges slightly outward therefrom in order to trap and contain fluid that is escaping from the well pipe through the breach. The containment sleeve is sealed to the well pipe, and a collection pipe runs from the containment sleeve to the collection reservoir.

After the containment sleeve is installed about the well pipe, the well valve is opened to allow the natural pressure from the well to push the control fluid out of the well pipe and hydrocarbon fluids to again be produced. The hydrocarbon fluid level will elevate to the level of the breach and escape therefrom through the well pipe, but will be contained by the surrounding containment sleeve. After a sufficient amount of hydrocarbon fluid accumulates therein, the fluid will be forced through the collection pipe and travel to the collection reservoir.

Finally, the excavated area will be filled with unpolluted earth. Thereafter, production of the hydrocarbon fluid may resume with minimal downtime, without removing or disrupting the positioning of the production tubing, and with the added benefit of unpolluted ground, all polluted ground having been transported to a cleaning or disposal facility.

The present invention provides a method and system for containing leaking hydrocarbon fluids from a well pipe of a production well. After collecting the escaping hydrocarbon fluids with a containment sleeve, the escaping hydrocarbon fluid is routed to a collection reservoir from which the hydrocarbon fluids may be easily recovered for commercial exploitation without causing environmental damage.

BRIEF DESCRIPTION OF THE DRAWINGS

The present invention, as well as further objects and features thereof, is more clearly and fully set forth in the following description of the preferred embodiment, which should be read with reference to the accompanying drawings, wherein.

DETAILED DESCRIPTION OF THE PREFERRED EMBODIMENT

Figure 1:
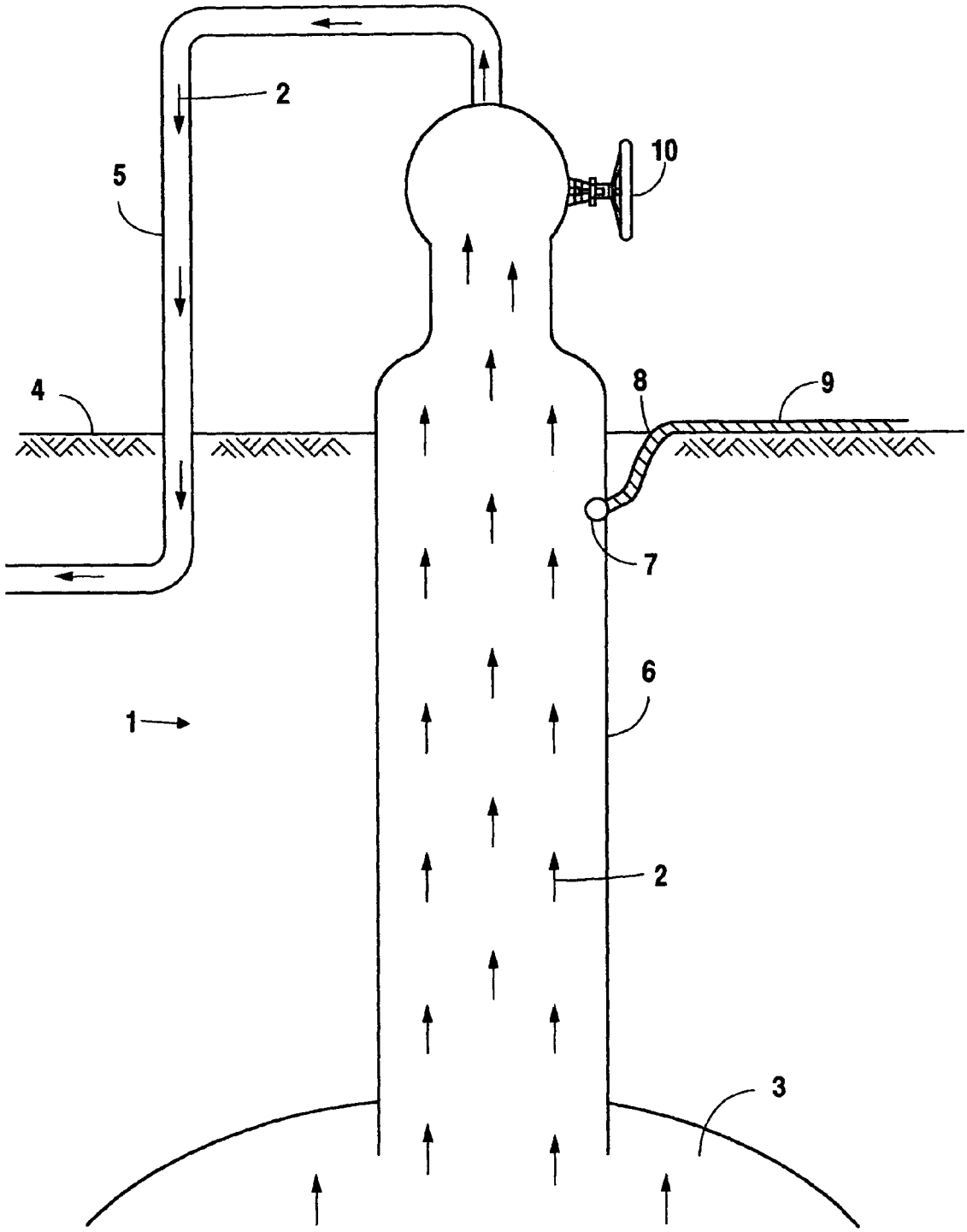
FIG. 1 shows a representation of a conventional hydrocarbon production well with a breach in a well pipe.

FIG. 1 illustrates a production well 1 positioned beneath a surface 4. In a typical hydrocarbon well, the natural well pressure forces hydrocarbon fluid 2 upward from a hydrocarbon production zone 3 into the production well 1, which includes a well pipe 6 that may be a casing pipe or a production pipe. By opening or closing a valve 10, a well operator either allows or inhibits flow of fluids between a production pipe 5 and the well pipe 6. A breach 7 in the well pipe 6, caused by corrosion or oxidation, allows the hydrocarbon fluid 2 to escape through the well pipe 6 and flow along a migration route 8 to the surface 4, where the hydrocarbon fluid 2 pools into a petroleum spill 9.

Figure 2:
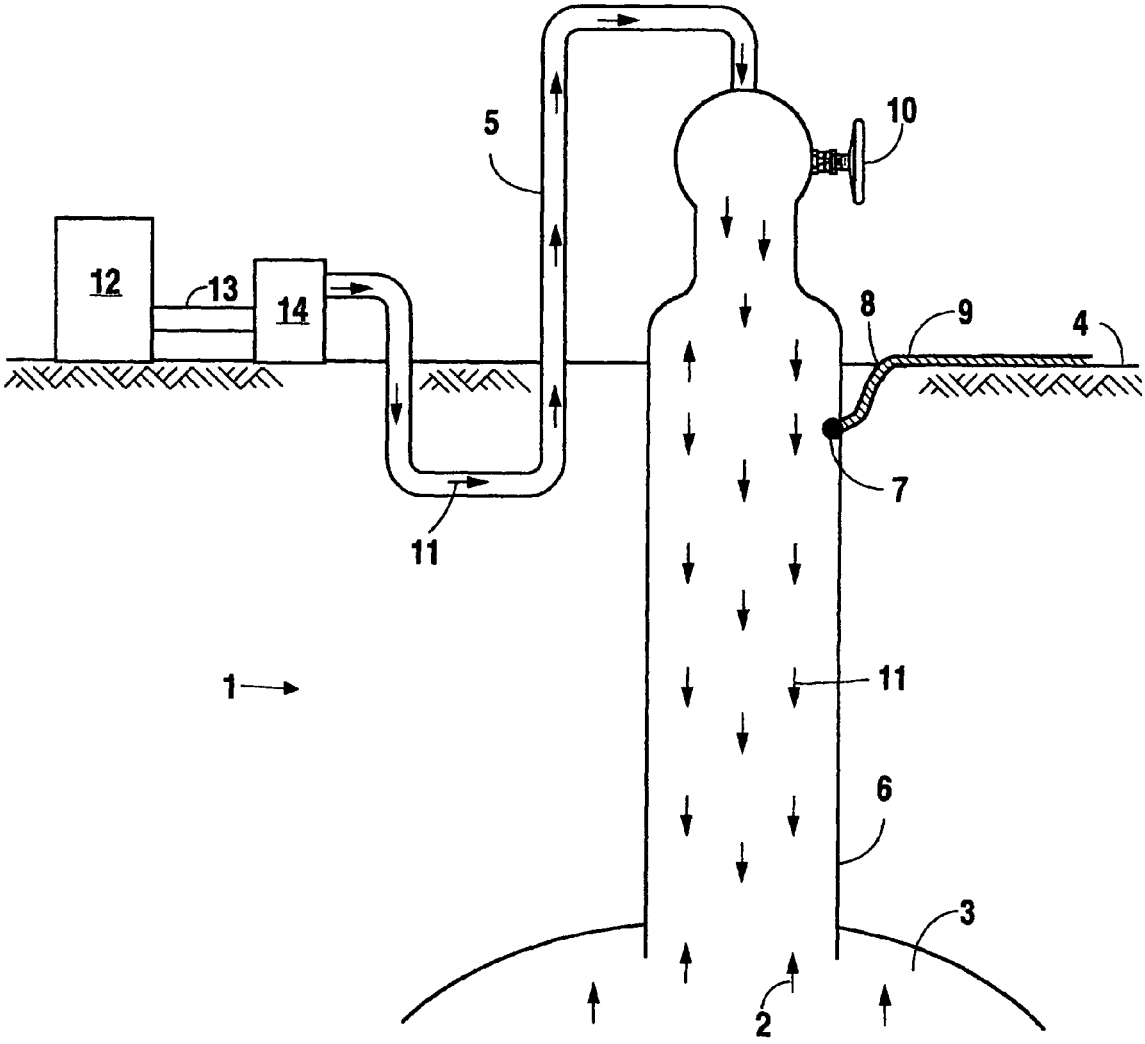
FIG. 2 shows the method of the present invention as applied to the oil well disclosed by FIG. 1.

FIG. 2 shows the preferred embodiment of a system of the invention, which is comprised of a holding tank 12 and a control pump 14 for moving the control fluid 11 through the production pipe 5 and into the well pipe 6. Before applying the method, the holding tank 12 stores the control fluid 11. After a breach 7 is detected, the control pump 14 draws control fluid 11 from the holding tank 12 through a connecting pipe 13 and pumps the fluid into the production pipe 5. As the control fluid 11 enters the well pipe 6, the density of the control fluid 11 forces down the hydrocarbon fluid 2 to a level beneath the breach 7 in the well pipe 6.

After the hydrocarbon fluid 2 is suppressed beneath the breach 7, according to one feature of the invention, the valve 10 is closed, thereby allowing the hydrocarbon fluid to remain stable in the bottom of the production well 1. Although some of the control fluid 11 will escape the breach 7, this is expected and preferred over escaping hydrocarbon fluids 2, as the control fluid 11 is chosen so as not to cause environmental damage around the production well 1.

Figure 3:
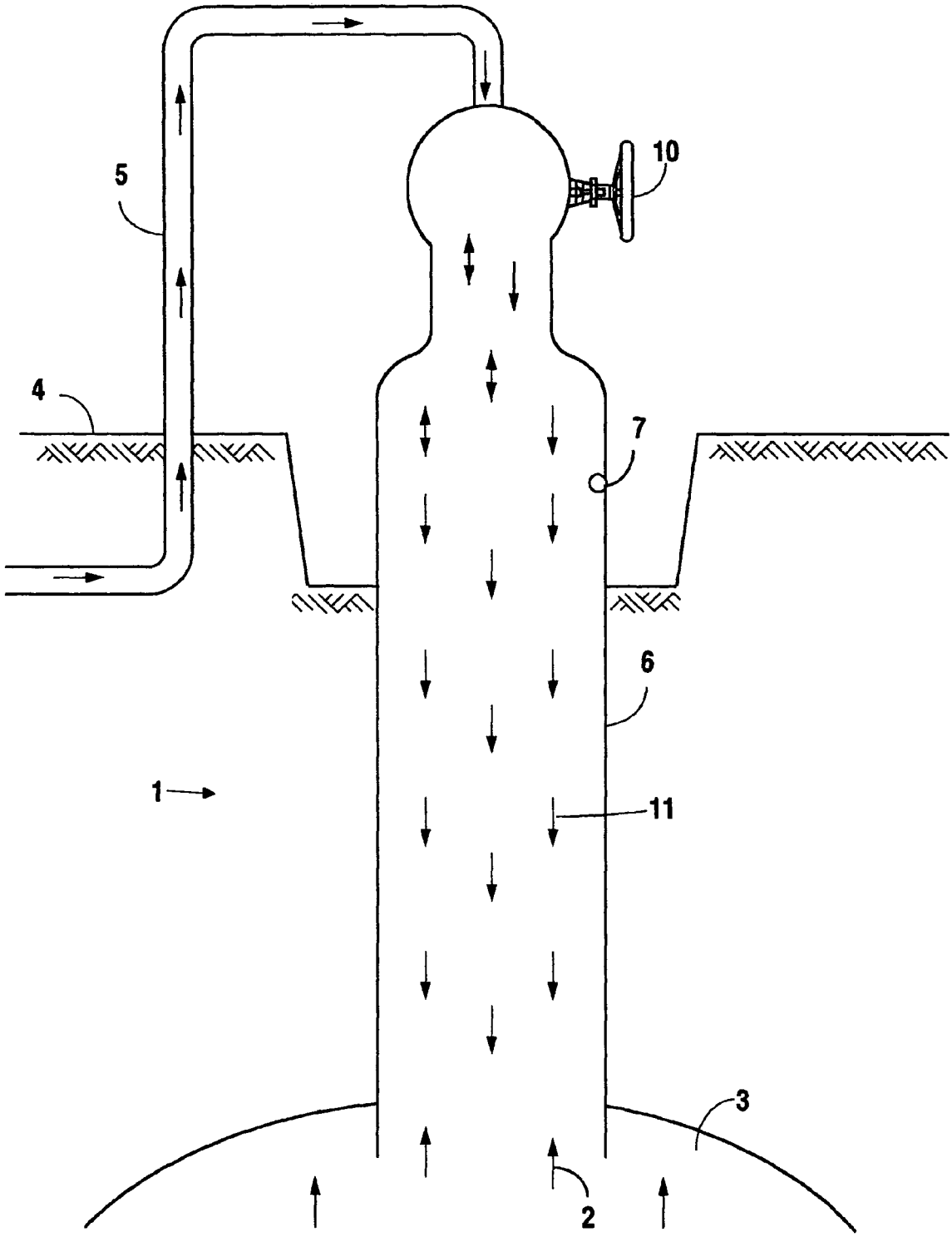
FIG. 3 shows the production well with earth excavated therearound to expose the breach in the well pipe.

As shown by FIG. 3, after the hydrocarbon fluid 2 has been suppressed and stabilized within the production well 1, earth surrounding the well pipe 6, and which may be contaminated from the previous escape of hydrocarbon fluid 2 through the breach, is excavated. The excavation leaves an exposed area of the pipe above the surface 4 by which the breach and surrounding area of the well pipe 6 may be accessed. The corroded area of the well pipe 6 surrounding the breach 7 may then be cleaned in preparation for sealing a containment sleeve 16 (not shown) thereto.

Figure 4:
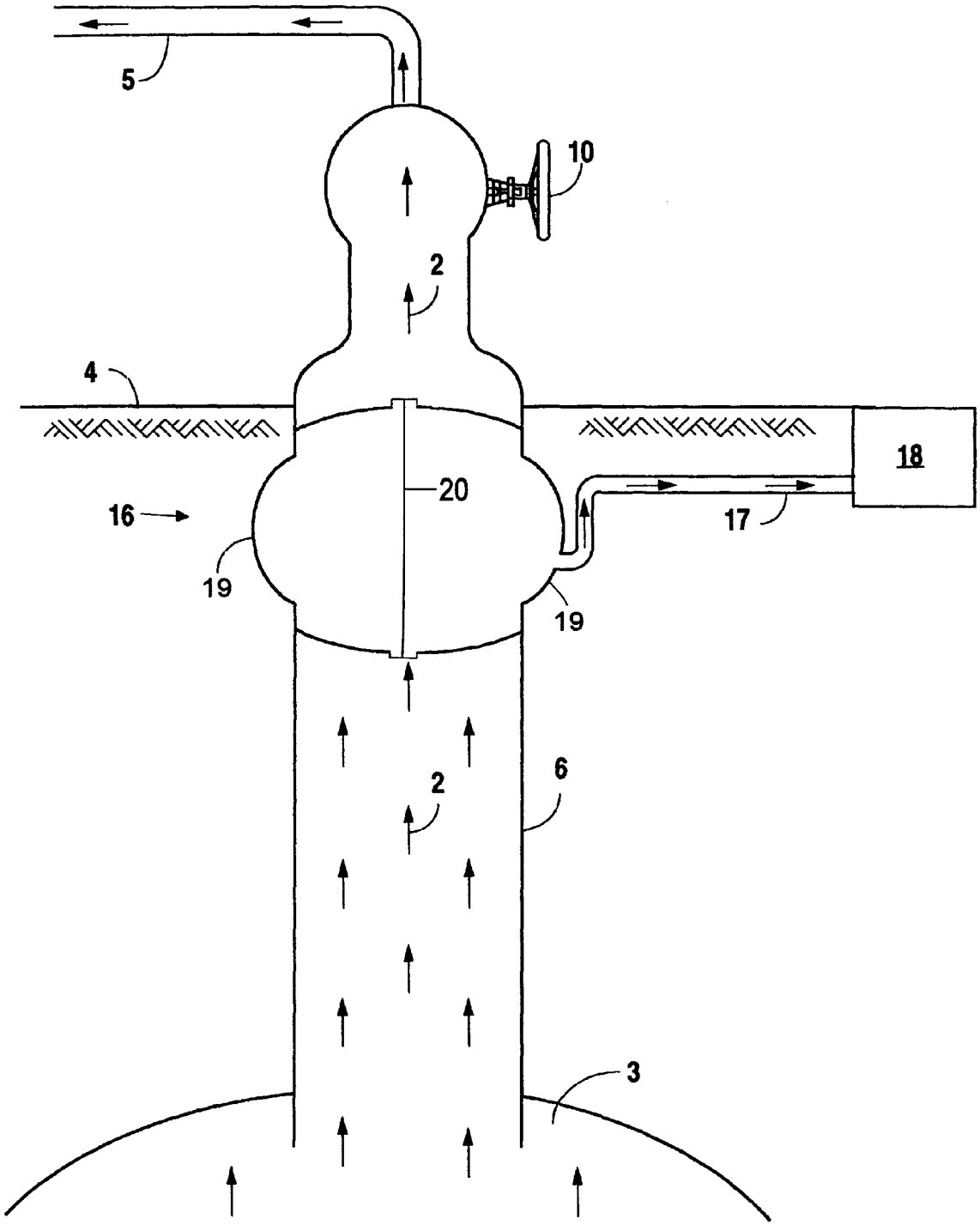
FIG. 4 shows a system of the present invention installed about the production well to recover hydrocarbon fluid therefrom.

As depicted in FIG. 4, after cleaning the corroded area of the well pipe 6, the containment sleeve 16 is installed. The containment sleeve 16 is comprised of two semi-ovular, non-metallic pieces 19 joined together about the breach 7 (not shown) at joint 20 and sealed to the well pipe 6 of the production well 1 where the well pipe 6 was previously cleaned. The cleaned area of the well pipe 6 allows formation of a better seal to contain fluid escaping from the breach between the containment sleeve 16 and the well pipe 6. Moreover, because of its non-metallic nature, the containment sleeve 16 will not corrode due it its inevitable subsequent exposure to the hydrocarbon fluid 2.

After attachment of the containment sleeve 16, the valve 10 is opened to allow the hydrocarbon fluid 2 to force the control fluid 11 (not shown) from the well pipe and production of the hydrocarbon fluid to resume. As hydrocarbon fluid 2 escapes the breach 7 (not shown), it accumulates between the containment sleeve 16 and the well pipe 6, then moves through a collection pipe 17 to a collection reservoir 18 from where it is later recovered. As shown in FIG. 4, the well valve 10 has been opened to allow resumed production of the hydrocarbon fluid 2 from the production zone 3.

Figure 5:
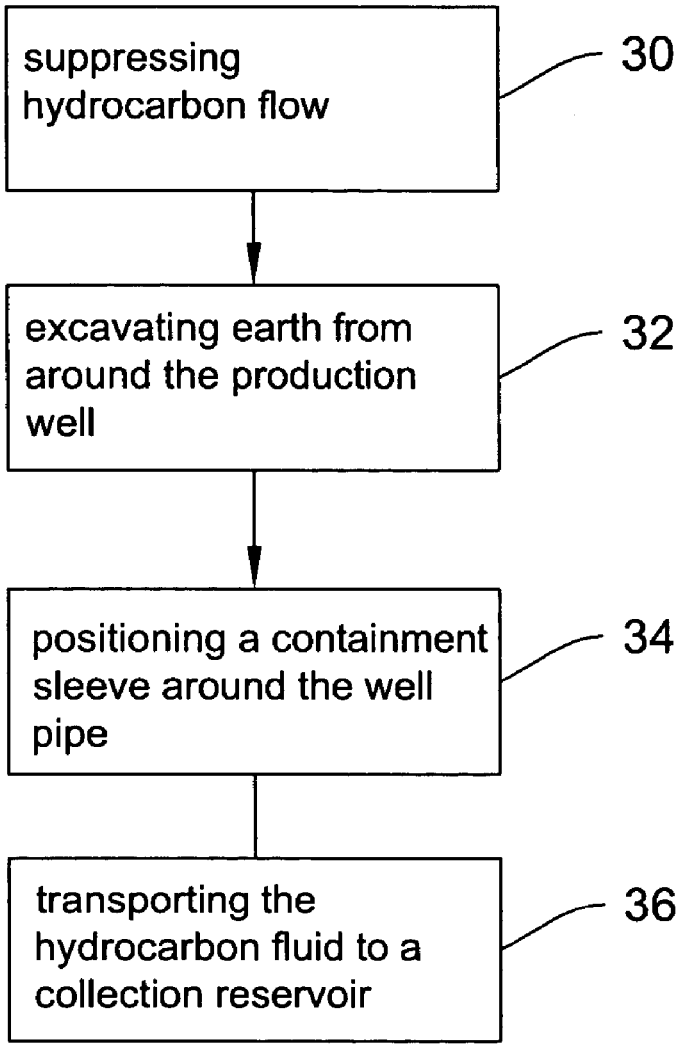
FIG. 5 discloses the preferred application of the method of the present invention as described by a flowchart.

FIG. 5 further depicts a method of the present invention, which comprises four essential steps: suppressing 30 the hydrocarbon fluid within the production well to a position below a breach in the well pipe; excavating 32 earth from around the production well until the breach within the well pipe is exposed; positioning 34 a containment sleeve around the well pipe to contain escaping hydrocarbon fluid within the containment sleeve; and transporting 36 the hydrocarbon fluid to a collection reservoir for storing.

Figure 6:
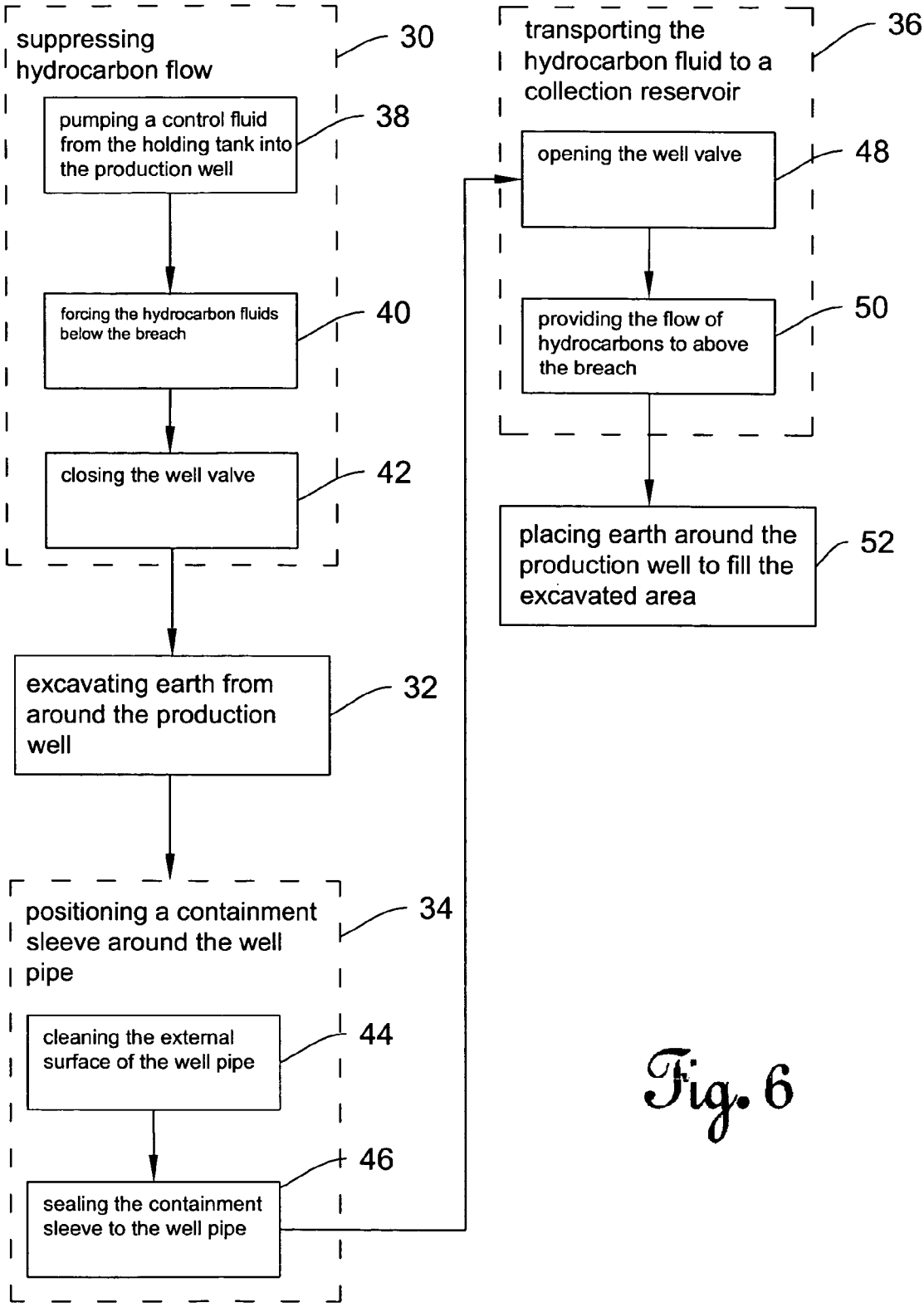
FIG. 6 discloses further detail of the flowchart of FIG. 5.

FIG. 6 illustrates the method of FIG. 5 with additional aspects and features thereof. The suppressing step 30 of the method may further include the additional steps of pumping 38 a control fluid from the holding tank into the production well, forcing 40 the hydrocarbon fluids below the breach in the well pipe, and then closing 42 the well valve to allow the hydrocarbon fluid in the well pipe to remain stable. After the excavating step 32, described in FIG. 5, positioning 34 the containment sleeve may further include first cleaning 44 the external surface of the well pipe before sealing 46 the containment sleeve thereto. The transporting step 36 of FIG. 5 may include opening 48 the well valve to allow the natural well pressure to push the control fluid out of the well pipe and providing 50 the flow of hydrocarbons to above the breach. Alternatively, the control fluid could be pumped from the well pipe using the control pump described herein. FIG. 6 also illustrates the step of placing 52 earth around the production well to fill the excavated area.

The present invention is described in terms of a preferred illustrative embodiment in which a specifically described system is described. Those skilled in the art will recognize that alternative embodiments of such a system, and alternative applications of the containment method, can be used in carrying out the present invention. Other aspects and advantages of the present invention may be obtained from a study of this disclosure and the drawings, along with the appended claims. Moreover, the recited order of the steps of the methods described herein are not meant to limit the order in which those steps may be performed, except as clearly required by the invention.

I claim:

1. A method for collecting hydrocarbon fluid escaping through a breach within a well pipe of a production well comprising:

suppressing the hydrocarbon fluid within said production well to a position below the breach within the well pipe;

excavating earth from around the production well until the breach within the well pipe is exposed, thereby providing an excavated area;

positioning a containment sleeve around said well pipe to contain escaping hydrocarbon fluid within said containment sleeve; and transporting said hydrocarbon fluid to a collection reservoir.

2. A method for collecting escaping hydrocarbon fluid, as recited in claim 1, further comprising the step of cleaning the external surface of said well pipe in a manner sufficient to allow sealing a containment sleeve to said well pipe, said cleaning step being subsequent to said excavating step and prior to said positioning step.

3. A method for collecting escaping hydrocarbon fluid, as recited in claim 2, further comprising the step of providing the flow of hydrocarbon fluid from the production well to a position above said breach.

4. A method for collecting escaping hydrocarbon fluid, as recited in claim 1, wherein said suppressing step further comprises pumping a control fluid into said production well until said hydrocarbon fluid is forced below the breach in the well pipe.

5. A method for collecting escaping hydrocarbon fluid, as recited in claim 4, wherein said suppressing step further comprises closing a well valve subsequent to said pumping step.

6. A method for collecting escaping hydrocarbon fluid, as recited in claim 5, wherein said control fluid is a brine solution.

7. A method for collecting escaping hydrocarbon fluid, as recited in claim 6, wherein said pumping step is preceded by the step of pumping said control fluid from a holding tank into said production well.

8. A method for collecting escaping hydrocarbon fluid, as recited in claim 1, further comprising the step of placing earth around said production well to fill said excavated area, said placing step being subsequent to said positioning step.

9. A method for collecting escaping hydrocarbon fluid, as recited in claim 1, wherein said positioning step further comprises sealing said containment sleeve to said well pipe to substantially contain the escaping hydrocarbon fluids between said containment sleeve and said well pipe.

10. A method for collecting escaping hydrocarbon fluid, as recited in claim 7, wherein said transporting step further comprises removing said control fluid from said production well into said holding tank.

11. A method for collecting escaping hydrocarbon fluid, as recited in claim 10, wherein said transporting step comprises opening a well valve.

12. A system for collecting hydrocarbon fluid escaping through a breach within a well pipe of a production well comprising:

control fluid having characteristics sufficient to suppress hydrocarbon liquid within said production well below said control fluid when said control fluid and said hydrocarbon liquid are contained within said well pipe, a holding tank for storing said control fluid;

a control pump for pumping said control fluid between said holding tank and said production well, said control pump having sufficient head pressure to overcome the natural well pressure and suppress the hydrocarbon liquids below said control fluid;

a containment sleeve made substantially of non-metallic material for sealing to the exterior surface of said well pipe and thereby containing said escaping hydrocarbon fluid between said containment sleeve and said well pipe; and a collection reservoir for receiving and storing said hydrocarbon fluid from said containment sleeve.

13. A system for collecting escaping hydrocarbon fluid, as recited in claim 12, where said control fluid is a brine solution.

14. A system for collecting escaping hydrocarbon fluid, as recited in claim 13, further comprising a collection pipe operably connected to said containment sleeve for fluid communication between said collection pipe and said collection reservoir.

15. A system for collecting escaping hydrocarbon fluid, as recited in claim 14, further comprising:

a connecting pipe operably connected to said holding tank and said control pump for fluid communication therebetween; and a production pipe operably connected to said control pump and said production well for fluid communication therebetween.

* * * * *